United States Patent [19]

Alexander

[11] Patent Number: 4,832,207

[45] Date of Patent: May 23, 1989

[54] COMBINATION OF A PAD INSTALLED ON A HOLDER AND THE METHOD OF ASSEMBLY OF THE PAD ON THE HOLDER

[75] Inventor: Herman Alexander, Merrick, N.Y.

[73] Assignee: Sandy Alexander, Inc., Clifton, N.J.

[21] Appl. No.: 709,528

[22] Filed: Mar. 8, 1985

[51] Int. Cl.[4] ..... A47F 7/00

[52] U.S. Cl. ..... 211/57.1; 40/649; 40/658; 206/449; 206/493; 206/806; 248/221.4; 248/225.1; 402/19

[58] Field of Search ..... 211/57.1, 59.1, 54.1, 211/45, 50; 206/526, 806, 813, 460, 449, 554; 40/11 R, 312, 10 R, 16.4, 16.2, 124.2, 124.4, 124, 308, 22; 248/220.3, 220.4, 221.1, 221.2, 309.2, 205.3, 221.4, 224.1, 214, 215, 220.2, 222.3; 402/19, 79, 501, 80 P; 438/137

[56] References Cited

U.S. PATENT DOCUMENTS

| | | | |
|---|---|---|---|
| 2,790,591 | 4/1957 | Rosen | 206/554 X |
| 3,144,960 | 8/1964 | Membrino | 206/554 X |
| 3,184,055 | 5/1965 | Davis et al. | 206/554 X |
| 3,503,695 | 3/1970 | Giampa | 402/80 P |
| 4,094,415 | 6/1978 | Larson | 248/220.3 X |
| 4,192,478 | 3/1980 | Coules | 248/222.3 |
| 4,286,764 | 9/1981 | Pfeifer | 248/220.3 |
| 4,382,416 | 5/1983 | Kellog-Smith | 248/222.3 |
| 4,572,380 | 2/1986 | Langwell | 211/57.1 |

FOREIGN PATENT DOCUMENTS

| | | | |
|---|---|---|---|
| 394334 | 6/1933 | United Kingdom | 402/80 P |

*Primary Examiner*—Blair M. Johnson

*Attorney, Agent, or Firm*—Roberts, Spiecens & Cohen

[57] ABSTRACT

The combination comprising a pad including a plurality of sheets of paper in juxtaposed array capable of being removed one by one and a holder attachable to a support and including a prong for support of the sheets of paper of the pad. The sheets of paper have respective holes and slits aligned with one another through which the prong is inserted, the slits extending radially from the holes. The prong includes a shank and an enlarged head forming shoulders at a juncture therebetween, the slits having a length related to the dimensions of the holes, the shank, the head and the shoulders to permit insertion of the head of the prong through the holes and slits from the back of the pad such that the head of the prong exits at the front of the pad and the sheets of paper rest on the shank and are restrained at the front of the pad by the shoulders.

16 Claims, 2 Drawing Sheets

FIG. 4
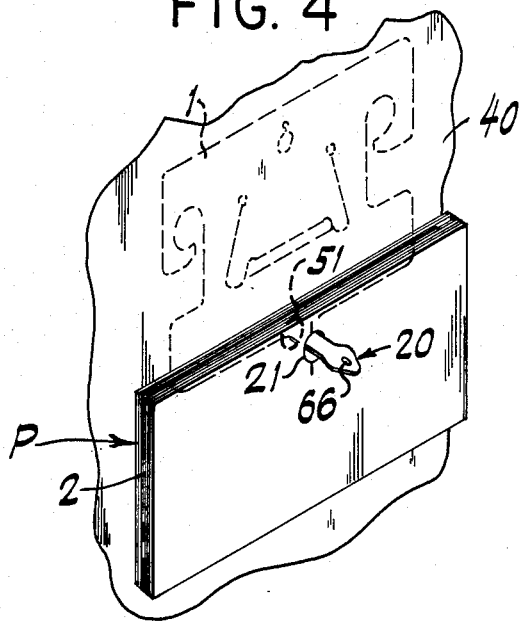
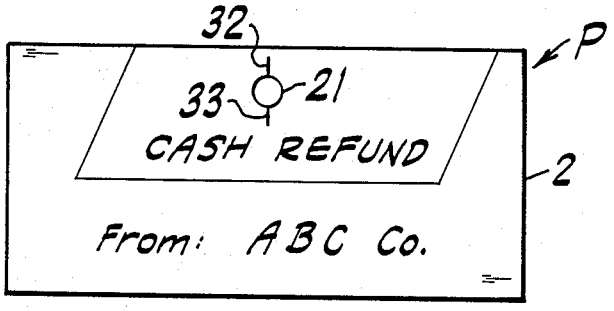
FIG. 5
FIG. 6
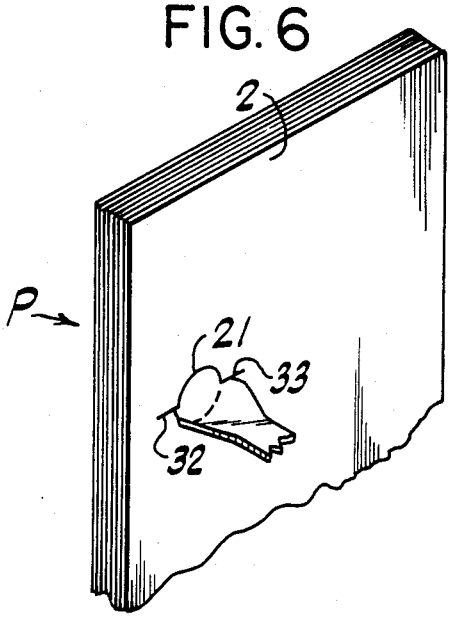
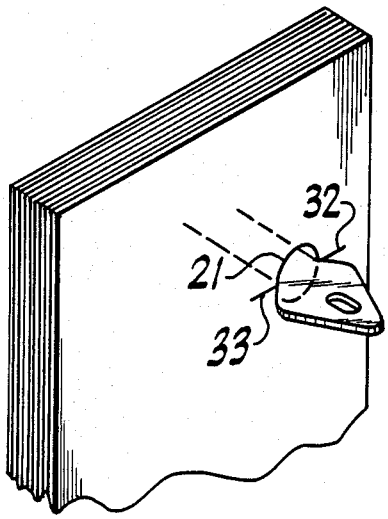
FIG. 7
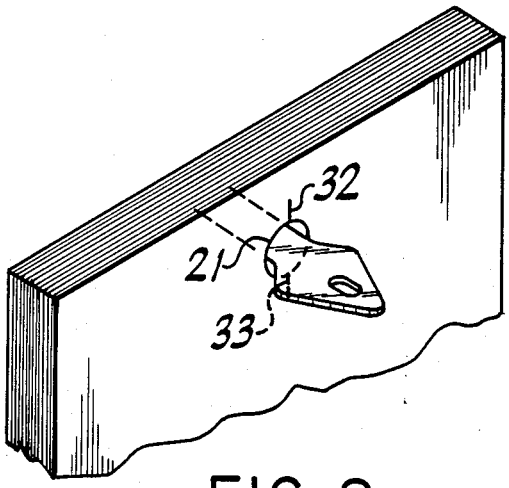
FIG. 8

COMBINATION OF A PAD INSTALLED ON A HOLDER AND THE METHOD OF ASSEMBLY OF THE PAD ON THE HOLDER

FIELD OF THE INVENTION

The invention relates to the combination of a pad installed on a holder at the front of a support and to the method of assembly of the pad on the holder.

The holder can be employed for attachment in a display channel at the edge of a shelf, for example, in a supermarket or for attachment to a riser card, or cut-case end.

The invention also relates to the method of supporting the pad on the holder.

DESCRIPTION OF PRIOR ART

The invention is particularly concerned with a pad and holder assembly adapted for use in a supermarket or like environment for dispensing informational sheets or promotional sheets, one by one, from a pad. Various types of holders or dispensers are known in the art for this purpose and these have a wide variety of forms and shapes and manners of installation.

A particularly relevant holder is disclosed in U.S. Pat. No. 4,572,380 and consists of a holder including a bendable prong on to which a plurality of sheets can be mounted in front of a support to which the holder is secured.

SUMMARY OF THE INVENTION

An object of the invention is to provide a method and means for mounting the sheets of paper of a pad onto the holder.

A further object of the invention is to provide a method and means by which the sheets of paper of the pad can be mounted onto the holder in the field without need for prior mounting by machine.

Yet another object of the invention is to provide a method and means by which the sheets of paper of the pad can be mounted on the holder manually and without need for machinery.

A feature of the invention is that holders which are installed in supermarkets can be utilized in place for the mounting of new pads which are supplied separately from the holder.

In order to satisfy the above and further objects of the invention, there is contemplated a combination comprising a pad including a plurality of sheets of paper in juxtaposed array capable of being removed one by one and holder means attachable to a support and including a prong for support of said sheets of paper of said pad. The sheets of paper have respective holes aligned with one another through which the prong is inserted and the sheets of paper are provided with respective slits aligned with one another and extending into the holes to facilitate engagement of the sheets of paper of the pad onto the prong. The prong includes a shank and an enlarged head with shoulders formed at the juncture between the shank and head. The slits have a length in relation to the dimensions of the holes, the shank, the head, and the shoulders to permit insertion of the head of the prong through the holes and slits from the back of the pad, such that the head of the prong exits at the front of the pad and the sheets of paper rest on the prong and are restrained at the front of the pad by the shoulders.

Once installed, the sheets of paper remain supported on the shank of the prong and the sheets can be removed one by one by being torn past the head of the prong.

In further accordance with the invention, in the installed condition, the prong extends in a horizontal plane and the slits extend in a vertical plane and more particularly vertically downwards from the hole. In this way, the sheets rest on the shank at the holes while the slits are in a vertical plane.

Installation of the sheets on the prong is achieved by inserting the head of the prong through the hole and slit until the head has emerged from the front of the pad whereafter the prong and pad undergo relative turning through an angle of 90°.

The invention is also drawn to the method of supporting the pad and comprises the operation of inserting the head of the prong through the hole and slit in the pad from the back thereof until the head of the prong extends at the front of the pad whereafter relative rotation of the pad and holder is effected so that the sheets of the pad rest on the shank of the prong and the slit is disposed at an angle relative to the shank.

The holder can be initially supported at the front of the support and the pad installed on the prong or, alternatively, the prong can be inserted through the hole and slit in the pad and the holder can thereafter be supported by the support.

By employing the method and arrangement of the invention, it becomes possible to supply pads to the user either to supplement or replace existing pads without need for supplying a respective holder for each pad, but rather utilizing the existing holders.

Further objects features and details of the invention will become apparent from a consideration of a specific embodiment of the invention taken with reference to the attached drawing.

BRIEF DESCRIPTION OF THE FIGURES OF THE DRAWING

FIG. 4 is a view similar to FIG. 1, showing the holder attached to a riser card.

FIG. 5 is a front view of the pad alone.

FIG. 6 is a perspective view showing the pad in position for assembly on the holder.

FIG. 7 shows the pad assembled on the holder in a first stage of assembly.

FIG. 8 shows the pad in a final assembled state on the holder.

DETAILED DESCRIPTION OF PREFERRED EMBODIMENTS

Figure 1:
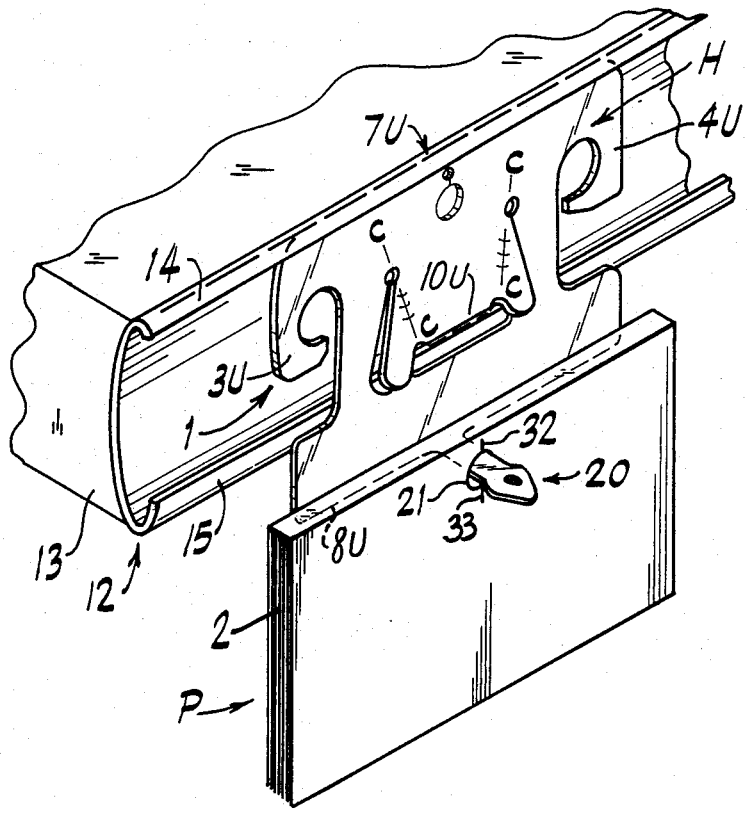
FIG. 1 is a front perspective view of a pad mounted on a holder secured to a channel at the front edge of a shelf.

FIG. 1 shows a holder H for a pad P composed of a plurality of sheet items 2 adapted for being removed from the holder one by one. The details of construction of holder H are disclosed in U.S. Pat. No. 4,572,380 and the holder will not be described herein except as regards its cooperation in the combination of the present invention.

The holder H is constituted of a sheet 1 of relatively thin flexible plastic material such as polyvinyl acetate, polyethylene, polystyrene or the like. The sheet 1 is of rectangular form with lateral wings 3U, 4U at the side edges of the sheet. The sheet has an upper edge 7U and a lower edge 8U. Extended from the lower edge 8U is a prong 20 which is adapted for engaging in holes 21 formed in the sheets 2 of the pad to be explained in greater detail later.

The holder H is constructed in a manner to be mounted in a channel 12 at the edge of a shelf 13. The channel is of the type normally found in supermarkets and used for the display of pricing information.

The channel 12 has upper and lower flanges 14,15 and the holder H is engaged in the channel by engagement of upper edge 7U with flange 14, and engagement of a tab 10U with the lower flange 15.

The tab 10U is formed with inclined re-entrant cuts 70 which extend into double curvature portions 71 leading to side edges 72 of the tab. As a consequence, at the lower sides of the tab there are formed ears 73 which are connected to lower edge 16U by undercut shoulders S formed by cuts 70 and 71.

In order to install the holder in channel 12, the upper edge 7U of the holder is engated with the upper flange of the channel and the tab 10U is bent rearwardly from the plane of sheet 1 so that lower edge 16U can engage behind the lower flange 15 of the channel 12. The ears 73 are disposed in front of the lower flange such that the shoulders S ride over the edges of the lower flange when the lower edge 16U is engaged within the channel 12. This provides a locking action which securely holds the holder in place to withstand the forces applied to the holder upon removal of the sheets from the prong.

In an alternative arrangement, as shown in FIG. 4, the holder is shown attached to a riser card 40. For this attachment, the prong 20 is inserted in a hole 51 formed in the riser card and in the hole 21 and slots 32,33 in the pad whereafter the holder and the pad are relatively turned through an angle of 90° whereby the pad is held in front of the riser card.

Heretofore, it has been the practice to furnish the pad in installed condition on the prong and for this purpose the prong has been furnished with a hole 66 which is engageable by a tool to forcibly pull the prong 20 through the hole 21 in the sheets 2 in order to install the pad on the holder. This requires the use of assembly apparatus and necessitates assembly at a location different from the place of use.

The present invention seeks to provide a construction whereby the pad can be installed on the prong at the point of utilization both at the outset and after the sheet of the pad have been all removed. This renders superfluous the hold 66 in the prong.

Figure 3:
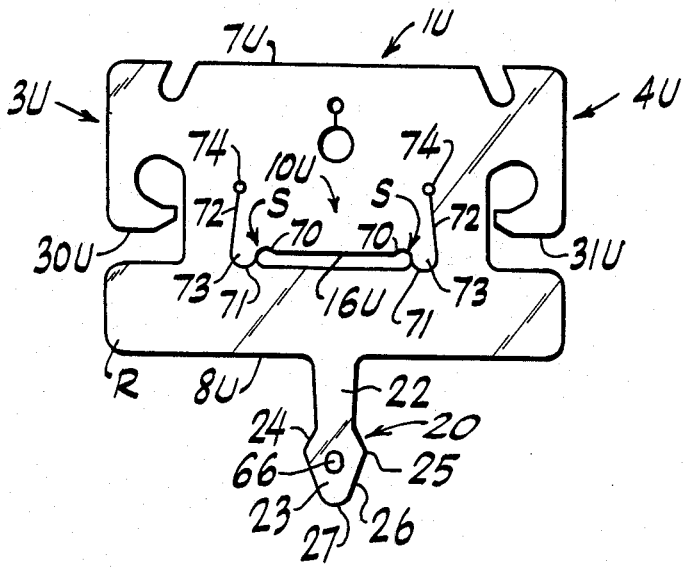
FIG. 3 is a front view of the holder alone.
Figure 2:
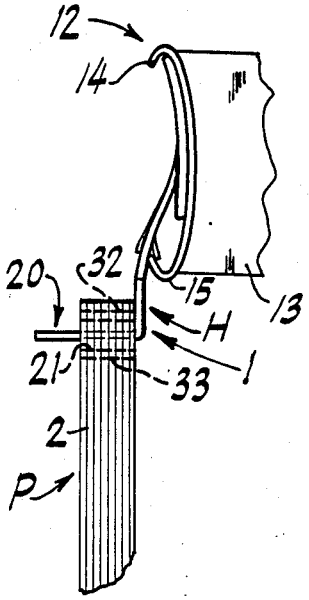
FIG. 2 is a side view of the assembly shown in FIG. 1.

Referring in greater detail to the shape of prong 20, as exemplified by FIG. 3, the prong comprises a stem or shank 22 and a head 23 on the stem. The head is joined to the stem by shoulder 24 which are tapered and increase in width until they reach a point of maximum width at 25. Thereafter, the head 23 decreases in width along sides 26 until the head reaches its free end which has a rounded form as shown at 27.

The sheets 2 of pad P are formed with the aligned holes 21 and, in accordance with the invention, the sheets are formed with respective slits 32 and 33 which extend from holes 21 in diametric opposition in a common plane. The dimension measured from the tip of slit 32 to the tip of slit 33 is just slightly greater than the maximum width 25 of the head of the prong. The diameter of hole 21 is greater than the width of stem 22, but less than the maximum width 25 of the head of the prong 20.

In order to install the pad on the holder, the prong 20 is aligned in the plane of slits 32 and 33 by turning the pad and prong to the relative position as illustrated in FIG. 6. The tapered sides 26 of the head of the prong are inserted into the slits 32 and 33 so that the head of the prong can pass from the back of the pad to the front so that the shoulders 24 will extend at the front of the pad. In this position, the pad and holder can be relatively turned through an angle of 90° as seen in FIG. 8 whereupon the sheets of the pad rest on the stem of the holder. In particular, as seen in FIG. 8, the prong lies in a horizontal plane so that the prongs support the sheets at the holes 21 while the vertical slits 32 and 33 are disposed vertically and take no part in the support of the sheets on the prong of the holder. In this position, the user can remove the sheets from the pad one by one by tearing the sheets off the prong past the head thereof.

With the construction of the invention, the pad can be installed on the prong whereafter the holder can then be installed at the edge of the shelf as shown in FIG. 1. Alternatively, the holder can be installed at the edge of the shelf or in the riser card and the pad can be installed on the prong.

In the construction described above, the slit has been shown with portions 32 and 33 and in accordance with the invention, it is sufficient to provide the slit only at the lower edge of the hole as shown at 33. The provision of the minor portion 32 at the top of the hole is to minimize the projection of the slit 33 into the display on the sheets 2 of the pad. It is within the contemplation of the invention, however, to provide the slit solely at 33 and to eliminate the minor portion 32.

In the removal of a sheet from the prong, the user usually engages the lower left or lower right corner of the sheet and pulls the sheet to disengage the same by application of pressure against the tapered shoulders 24 of the prong. The sheets are usually adhesively joined at their upper edges and the slit 33 at the lower edge of the hole facilitates the removal of the sheet from the prong with minimum tearing at the hole.

By virtue of the invention, there has been provided a relatively simple means and method by which the pad can be mounted on the prong at the location of use and the sheets can be removed one by one from the pad by the users. Thereafter, replacement of a fresh pad after exhaustion becomes a relatively simple matter.

Although the invention has been described in relation to specific embodiments thereof, it will become apparent to those skilled in the art that numerous modifications and variations can be made within the spirit and the scope of the invention as defined by the attached claims.

What is claimed is:

1. The combination comprising a pad including a plurality of sheets of paper in juxtaposed array capable of being removed one by one, and holder means attachable to a support and including a flat prong for support of said sheets of paper of said pad, said sheet of paper having respective circulcular holes aligned with one another through which said prong is inserted, said sheets of paper being provided with respective slits aligned with one another and extending into said holes to facilitate engagement of said sheets of paper of said pad onto said prong, said prong including a shank and an enlarged head on said shank, said head and shank forming shoulders at a juncture therebetween, said slits having a length related to the dimensions of said holes, said shank, said head and said shoulders to permit insertion of said head of the prong partly through said holes and partly through said slits from the back of the pad such that said head of the prong exits at the front of the pad and the sheets of paper rest on said shank and are restrained at the front of the pad by said shoulders.

2. The combination as claimed in claim 1 wherein said flat prong extends in a horizontal plane and said slits are rectilinear and extend in a vertical plane with said holder means attached to said support.

3. The combination as claimed in claim 2 wherein said slit extends radially of each hole.

4. The combination as claimed in claim 3 wherein said slit extends vertically downwards from each hole.

5. The combination as claimed in claim 3 wherein in the plane of each slit, the combined extent of the length of the slit and the diameter of the hole is greater than the maximum transverse extent of the prong to enable insertion of the prong, the diameter of the hole being less than said maximum transverse extent of the prong.

6. The combination as claimed in claim 5 wherein said slit includes major and minor portions respectively extending radially from each hole at diametrically opposed locations.

7. The combination as claimed in claim 5 wherein said slit extends vertically with said holder means attached to the support, said prong being installed in said pad by insertion of said head into said holes and said slits from the back end of the pad until said head exits from the front end of the pad whereafter the pad and holder means undergo relative rotation of 90°.

8. The combination as claimed in claim 7 wherein said slit extends vertically downwards from said hole.

9. The combination as claimed in claim 7 wherein said slit includes major and minor portions respectively extending radially from each hole at diametrically opposed locations.

10. The combination as claimed in claim 9 wherein said major portion of said slit extends vertically downwards and said minor portion extends vertically upwards.

11. The combination as claimed in claim 7 wherein with said holder means attached to the support, said prong supports said sheets of paper of said pad by resting said sheets on said shank at said holes, said shank lying in a horizontal plane while said slits are in a vertical plane.

12. The combination as claimed in claim 5 wherein the diameter of said hole is greater than the transverse extent of the shank and less than the transverse extent of the head whereby to remove the sheets of paper one by one, the sheets are successively torn past the head of the prong.

13. A method of supporting a pad, composed of sheets of paper, at the front of a support, said method comprising providing a pad including a plurality of sheets of paper in juxtaposed array capable of being removed one by one from the pad, forming through the sheets of paper of the pad, a circular hole and a slit extending radially from the hole, providing a holder having a flat prong formed with an enlarged head and a narrower shank with shoulders at the juncture of the head and shank, inserting the head of the prong in part through the hole and in part through the slit in the pad from the back thereof until the head of the prong extends at the front of the pad, and effecting relative rotation of the pad and holder so that the sheets of the pad rest on the shank of the prong and the slit is disposed at an angle relative to said shank, said holder being supported at the front of a support.

14. A method as claimed in claim 13 wherein said shank extends in a horizontal plane and said slit extends vertically downwards from said hole.

15. A method as claimed in claim 13 wherein said holder is initially supported by said support with said flat prong extending in a horizontal plane and said pad is installed on the flat prong by inserting the head of the prong in part through the hole and in part through the slit until the head exits at the front of the pad and then turning the pad to a horizontal position.

16. A method as claimed in claim 15 wherein the pad is installed on the holder with the slit disposed horizontally and the pad is turned a quarter turn to its horizontal position at which the slit is disposed vertically.

* * * * *